United States Patent [19]

Divoux et al.

[11] Patent Number: 4,591,142

[45] Date of Patent: May 27, 1986

[54] STACKER FOR FLAT OBJECTS

[75] Inventors: Michel Divoux, Bourg De Peage; Bernard Constant, Beaumont Les Valence; Marcel Ranchon, Bourg-Les-Valence, all of France

[73] Assignee: Hotchkiss-Brandt Sogeme H.B.S., Paris, France

[21] Appl. No.: 565,816

[22] Filed: Dec. 27, 1983

[30] Foreign Application Priority Data

Dec. 30, 1982 [FR] France ..... 82 22071

[51] Int. Cl.[4] ..... B65H 29/24; B65H 31/04

[52] U.S. Cl. ..... 271/196; 271/184; 271/214; 271/178

[58] Field of Search ..... 271/196, 183, 184, 314, 271/207, 213, 214, 176, 177, 178, 179, 180, 181, 96, 108

[56] References Cited

U.S. PATENT DOCUMENTS

| | | | |
|---|---|---|---|
| 2,844,373 | 7/1958 | Van Marle | 271/178 |
| 4,261,559 | 4/1981 | Mitzel | 271/184 X |
| 4,440,388 | 4/1984 | Divoux et al. | 271/196 X |

FOREIGN PATENT DOCUMENTS

| | | |
|---|---|---|
| 651187 | 11/1964 | Belgium . |
| 2410619 | 6/1979 | France . |
| 2489798 | 3/1982 | France . |

*Primary Examiner*—Bruce H. Stoner, Jr.
*Assistant Examiner*—Lawrence J. Goffney, Jr.
*Attorney, Agent, or Firm*—Oblon, Fisher, Spivak, McClelland & Maier

[57] ABSTRACT

The invention relates to a stacker for flat objects, in which a conveyor moves the objects to be stacked in in an edgewise manner. A drum rotates permanently in front of the orifice of a hollow cylindrical body, connected to a suction source. The stack of already stacked objects is engaged against said drum. A shell, controlled in rotation, controls the application of suction through the openings of the drum, of an object inserted between the drum and the stack. Suction application is timed to correspond to a displacement of the leading edge of the object inserted between the orifice and the stopping border of the receptacle. Application to postal sorting.

6 Claims, 4 Drawing Figures

STACKER FOR FLAT OBJECTS

BACKGROUND OF THE INVENTION

The invention relates to a stacker for random flat objects and more particularly for envelopes. It more specifically relates to a stacker, which arranges in the form of horizontal stacks, flat objects supplied in unitary and vertical manner by e.g. a belt conveyor.

Numerous stackers performing this function equip the discharge points of presently functioning envelope sorting machines. Such equipment has a satisfactory performance level for the use made of it. Thus, the manual taking up again by an operator of the stack of flat objects formed allows certain random defects in the arrangement of said objects. These defects are in particular a variation of the slope of the objects in the stack, a variation in the height, rearward displacement or slight folding of the leading edge of said objects.

However, when it is a question of the automatic take-up of objects stacked in a stacker, it is indispensable to have a stack not suffering from the aforementioned minor defects. The present invention therefore relates to a stacker for flat objects, which obviates these defects, whilst maintaining said objects during the stacking operation.

SUMMARY OF THE INVENTION

The present invention therefore specifically relates to a stacker for flat objects moved in an edgewise manner by a conveyor, said stacker comprising a drum which rotates on itself permanently about a fixed, hollow cylindrical body, which is substantially orthogonal to the arrival direction of the objects and whose generatrixes are substantially parallel to the surface of said objects, the complete periphery of the drum being provided with a plurality of regularly distributed openings for permitting the passage of air between its outer and inner faces, said body being provided with a suction circuit whereof one end opens out onto an orifice of said body in order to successively cooperate with said openings during their passage in front of the orifice, thus ensuring the taking up by suction of the objects moved in and their movement towards a receptacle whereby they are stacked, wherein it comprises moving means for supporting the edges of the objects, in such a way that the outer face of the drum permanently faces the stack of the objects stacked in the receptacle, means for inserting these objects arranged so as to direct each object between the stack and the outer face, suction control means inserted in said circuit, and control means ensuring that the suction is limited to the time between the insertion instant of each of the objects and the instant at which said objects have been placed in the receptacle.

BRIEF DESCRIPTION OF THE DRAWINGS

The invention is described in greater detail hereinafter relative to non-limitative embodiments and the attached drawings, wherein show.

DETAILED DESCRIPTION OF THE INVENTION

Figure 1:
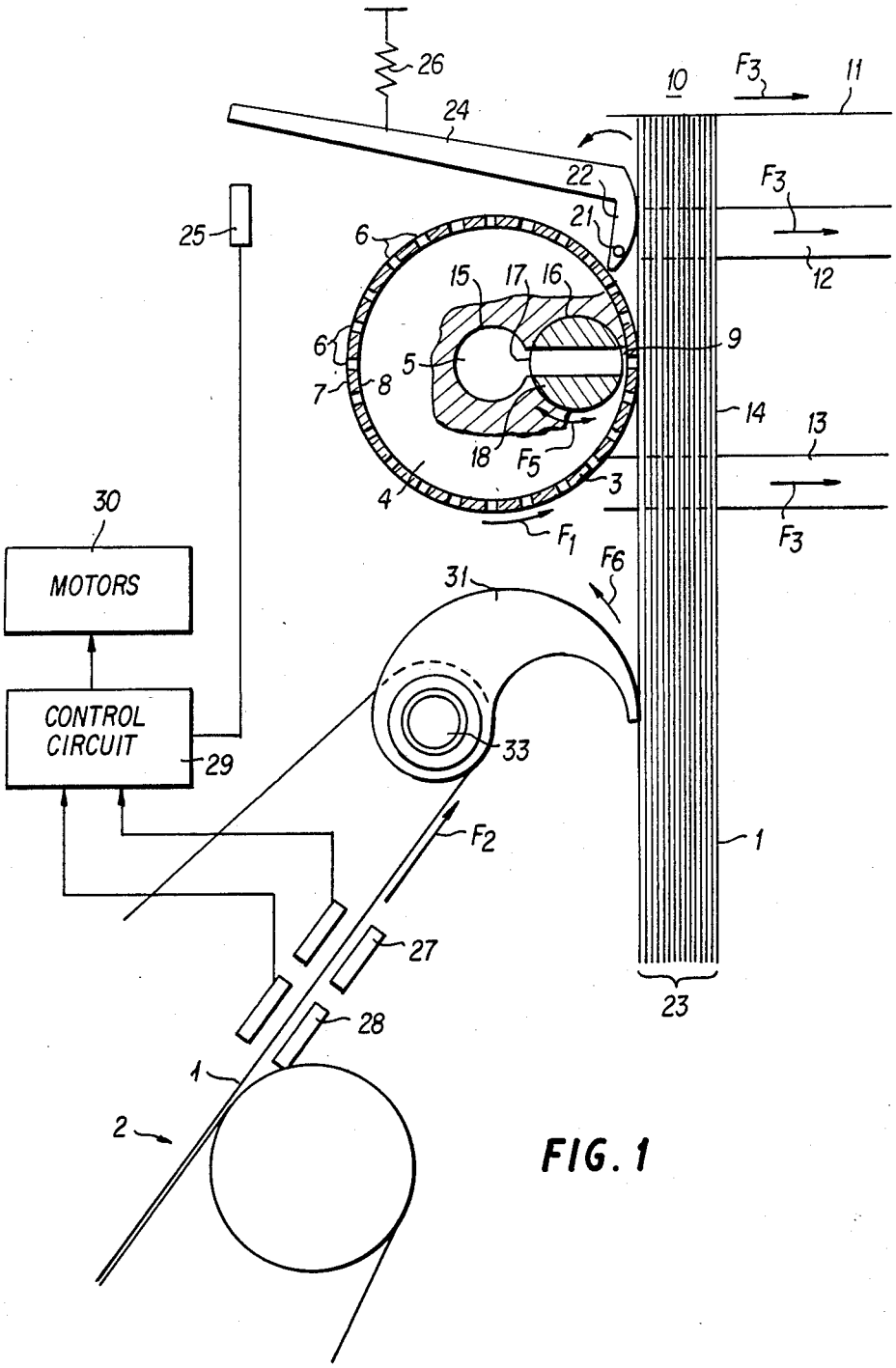
FIG. 1 a plan view of the stacker according to the invention.

FIG. 1 shows in plan view, a cross-section of the stacker according to the invention. Flat objects 1 are moved in in edgewise manner thereto by a belt conveyor 2. A drum 3, rotating on itself in the direction of arrow F1, is mounted coaxially on a fixed cylindrical body 4, having a cavity 5. The rotation axis of the drum 3 is orthogonal to the arrival direction of the objects 1 in accordance with arrow F2 and is substantially parallel to the surface of these objects. Drum 3 has a plurality of regularly spaced openings 6 on its periphery. These openings 6 establish a link for the passage of air between the outer face 7 and inner face 8 of drum 3.

Cavity 5 in cylindrical body 4 has an orifice 9 opening onto the surface of body 4. In a preferred manner, orifice 9 is elongated and is colinear to the generatrix of the cylindrical body 4 substantially closest to a receptacle 10. Receptacle 10 has a stopping border 11 and conveying means consisting of a set of belts 12, 13 and a guidance plate 14. Belt 12, 13 and guidance plate 14 move in the direction of arrow F3 during the stacking operation.

Cavity 5 of body 4 is permanently connected to a not shown suction source. It has a substantially figure of eight cross-section. It is consequently divided into two parts having a circular cross-section, parts 15 and 16 being interconnected by a channel 17. Orifice 9 is located in the extension of parts 15 and 16 issuing onto the periphery of body 4. The circular cylindrical part 16 is used for housing an elongated shell 18, which acts as a valve and is shown here in its open position. It permits the passage of air coming from the outside, through one or more openings 6, in the direction of the suction source. Openings 6 pass in front of orifice 9.

A pedal 20, articulated to a spindle 21 parallel to the drum axis, has a friction pad 22 flush with the bundle 23 of flat objects 1 stacked in receptacle 10. A lever 24 of pedal 20, located on the same side as friction pad 22 with respect to spindle 21, acts on a detector 25. Pedal 20 is kept in a position of equilibrium by a return spring 26. Detector 25 can be of an electromechanical type. A set of detectors 27, 28, e.g. of a photoelectric type, determines the passage times of the objects 1 on belt conveyor 2. Electrical signals processed by detectors 25, 27 and 28 are passed to a control circuit 29, e.g. an electronic circuit. As a function of the information received, the control circuit 29 controls the starting up of a set of motors 30. These not shown motors more particularly control the rotation of shell 18 and the forward movement of the conveying means from receptacle 10.

The operation of the stacker according to the invention will now be described. Conveyor 2 is arranged on the side of drum 3 and its outlet is oriented in an oblique direction with respect to the surface of the objects already stacked in the receptacle. It guides the object 1 to be stacked, in order to insert it between the bundle of objects 23 and drum 3. On leaving conveyor 2, object 1 hides the photoelectric cell of detector 27 and the latter transmits a pulse to the control circuit 29. After a time lag corresponding to the time necessary for the insertion of the leading edge of object 1 between bundle 23 and drum 3, control circuit 29 transmits an instruction to the motors for tilting shell 18. The latter then rotates in the direction of arrow F5, from a closed position into an open position shown in FIG. 1. Under these conditions, the suction source connected to cavity 5 exercises a suction action on the rear face of the leading edge of the flat object to be stacked. The term rear in rear face relates to the forward movement direction thereof in receptacle 10.

As the drum is permanently rotating, it moves object 1 to be stacked in the direction of the stopping border 11. Orifice 9 has a development on the periphery of body 4 limited to approximately 2 to 3 times the width of the distribution spacing of openings 6 on drum 3. As soon as the openings 6 of drum 3 which have participated in the suction of the object to be stacked have passed the limit of orifice 9, they are no longer linked with the suction source. The leading edge of the objects then engage in rolling contact on said active openings of the drum and is naturally disengaged.

The drum continues its action until the leading edge of the object to be stacked abuts against the stopping border 11. The duration of this elementary action is limited by a time lag taking account of the rotation speed of the drum and the distance separating the stopping border 11 and the diameter of said drum parallel to the stopping border. This time lag is a function of the time taken by the leading front of the object to be stacked to cover the distance separating orifice 9 from border 11. At this instant, the control circuit transmits an instruction, which is opposite to the preceding instruction, to the motor actuating shell 18, in order to interrupt suction.

Thus, on the one hand, the regulation of the duration of the suction action makes it possible to obtain a uniform stopping of all the objects to be stacked. On the other hand, the stacking action exerted by the drum must be short. Moreover, in order not to suffer from the time taken by placing under suction, the invention disposes the shell 18 directly downstream of the inner face 8 of drum 3. Under these conditions, the time taken for suction to be applied is reduced to the time taken for placing the inner volume of shell 18 under vacuum. As this volume is small, the action is fast. Moreover, during the closing of the valve, the interruption of the suction action is once again very fast. Thus, the setting of the suction time is accurate.

During its forward movement, the stacked flat object 1 rubs under the friction pad 22 of pedal 20. As a result, pedal 20 rotates about its spindle 21 in the direction of arrow F4. The end of lever 24 of this pedal excites detector 25, which processes an instruction in the direction of control circuit 29. The latter then controls the action of the motors of conveying means 12, 13, 14. The displacement of the conveying means brings about the decompression of bundle 23 until the friction exerted by friction pad 22 on the new stacked objects is inadequate to oppose the return or release stress of spring 26. In this case, pedal 20 reassumes its rest position and interrupts the action of the motors of the conveying means. However, the aforementioned arrangement can be quite different. In particular, if the objects to be stacked have uniform dimensions, it is possible to eliminate both pedal 20 and detector 25, said means being replaced by a supplementary sequential action produced by the control circuit 29 and initiated by the pulse from detector 27. This sequential action then has the effect of advancing the conveying means by one notch, whose amplitude corresponds to the thickness of the objects to be stacked.

Another feature of the invention is that the bundle of objects 23 is stacked in a substantially horizontally extending receptacle 10. The vertical maintenance of these objects 1 in the horizontal stack from the side of the stacking means is essentially brought about by the generatrixes of the drum in contact with said bundle. When no object is moved in, or between the arrival of two objects, the suction source is no longer connected to opening 6, so that the outer face 7 of the drum slides without friction on the stacked objects 1. It vertically maintains or supports the same and to this end face 7 is preferably smooth.

Figure 2:
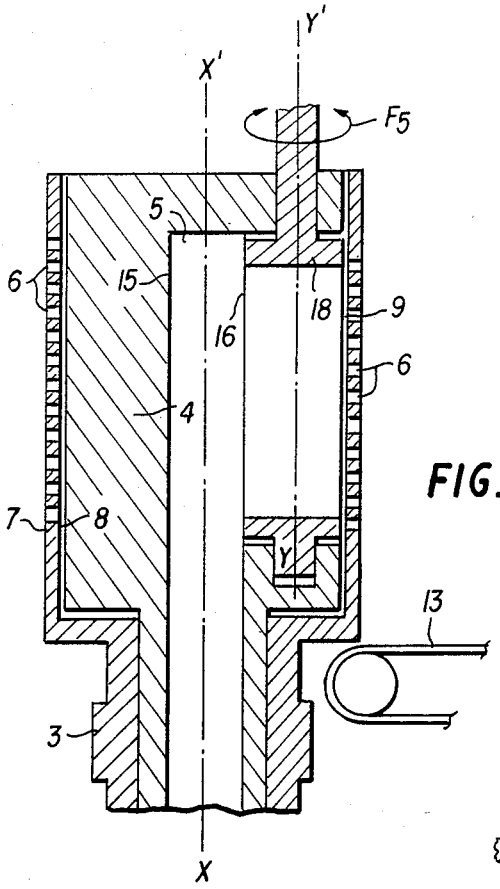
FIG. 2 a section in a vertical plane of the suction control means.
Figure 4:
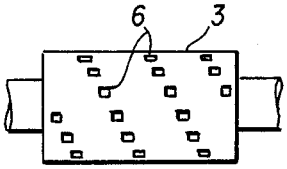
FIG. 4 a plan view of a drum with helical openings.

FIG. 2 shows a section of drum 3 and body 4 of the stacker in a plane perpendicular to the faces of the stacked objects. It is pointed out that the rotation axis XX' of the drum is parallel to the rotation axis YY' of the shell 18 in its part 16. Thus, shell 18 rotates on itself in alternating manner in the direction of the double arrow F5, under the control of control circuit 29. According to a variant, openings 6 are slots made along the generatrixes of the drum over the entire circumference thereof. According to another variant of the invention, the openings 6 made in the drum are holes, which can be distributed over the entire height of the drum in a plurality of alignments, parallel to a certain number of generatrixes of the drum, said generatrixes being regularly distributed with a given spacing all around the drum. In a preferred variant shown in FIG. 4., the holes are distributed over a plurality of helical alignments, which are displaced relative to one another by a given spacing over the entire periphery of the drum.

The reason for these special distributions of the openings is the need to reduce the noise caused by the passage of air during the suction periods. The arrangement of the holes in the form of displaced helical alignments have the effect of breaking the rhythm with which said noise appears, linked with the distribution spacing of the holes. Thus, in front of the longitudinal opening 9, the vertical distribution of the holes is no longer uniform. Under these conditions, it is possible to reduce the development of orifice 9 to a width less than the displacement spacing of the helical alignments. FIG. 2 also shows the belt 13 of the conveying means for receptacle 10. Thus, belt 13 provides a horizontal support for the stacked bundles 23.

Figure 3:
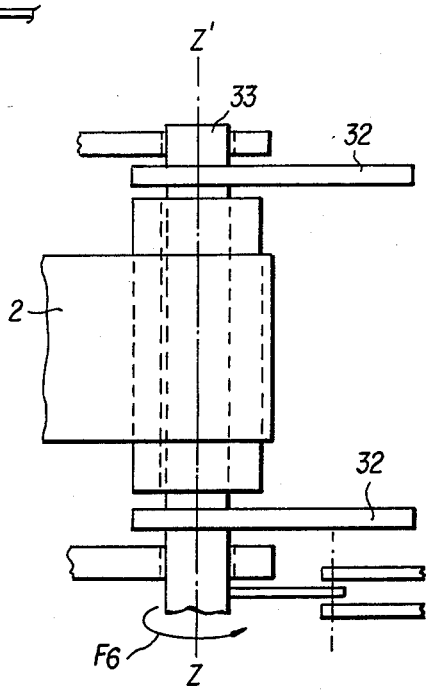
FIG. 3 a section in the vertical plane of an accessory of the stacker according to the invention.

FIG. 3 shows in section a maintaining accessory according to the invention. This accessory is a cam 31 and is also visible in FIG. 1 at the outlet point from conveyor 2. Cam 31 has two fingers 32 having a comma-like configuration and fixed to a shaft 33, which can rotate about an axis ZZ' parallel to the drum axis. These two fingers are vertically spaced in order to bear at two points on the rear face of the stacked objects. The rotation takes place in the direction of arrow F6 (FIG. 1). Shaft 33 is driven by a not shown motor, which is also controlled by control circuit 29. The cam operates in the following manner. When the leading edge of an object hides the photodetector 28, the latter emits an electrical pulse in the direction of circuit 29. This circuit actuates the motor of cam 31, so that it performs a turn on itself. The speed and passage time of this cam 31 are calculated in such a way that its end gives way in front of the leading edge of the arriving objects to be stacked and in such a way that in a continuous rotary movement it engages the trailing edge of the objects just stacked against bundle 23.

Thus, the cam 31 has two functions. In its first function, it makes it possible for the leading edge of a newly moved-in object to be inserted between drum 3 and bundle 23 in the vicinity of orifice 9. Thus, as a function of the nature of the objects and their shaping, the trailing edges of the stacked objects can move apart in fanlike manner in the stack and consequently impede the insertion of a new object. Cam 31 is only necessary when the discharge point of conveyor 2 only slopes slightly relative to the normal at the stopping border 11. A second function consists of participating in maintaining the bundle of objects 23 in receptacle 10. In FIG. 1, cam 31 is shown in the working position. This is not its rest position, which is such that the orientation of the cam slopes substantially with respect to the normal at the faces of the objects of bundle 23.

In a preferred manner according to the invention, the distance separating the end of conveyor 2, which is substantially level with detector 27, from orifice 9, is less than the length of the objects to be stacked. This length is measured perpendicularly to the stopping border 11. The difference between these two lengths is less than the distance separating orifice 9 and stopping border 11, which enables the cam 31 to push back the trailing edges of the objects to be stacked, without their catching on the outlet of conveyor 2, which could lead to jamming effects.

Following an adjustment phase more particularly relating to the setting of the time lags, it proved possible to stack envelopes without any jamming problems and in which the stopping tolerances of the stopped objects against the stopping border 11 were less than the tolerances admitted by the means for the automatic processing of stacked objects, such as e.g. destackers.

What is claimed is:

1. A stacker for flat objects moved in an edgewise manner by a conveyor, said stacker comprising:

(a) a fixed cylindrical body;

(b) a cylindrical drum:

(i) which is coaxial with and overlies said fixed cylindrical body;

(ii) which is mounted for rotation around said fixed cylindrical body; and (iii) which has a plurality of circumferentially spaced radial through holes therethrough;

(c) first means for rotating said cylindrical drum;

(d) a cylindrical valve:

(i) mounted in said fixed cylindrical body for rotation about an axis which is parallel to the axis of said fixed cylindrical body and (ii) having a diametric through slot sized, shaped, and positioned so that said through slot can be placed in fluid communication with said through holes in said cylindrical drum;

(e) second means for communicating vacuum to said through slot in said cylindrical valve when said through slot is in fluid communication with said through holes in said cylindrical drum;

(f) third means for rotating said cylindrical valve;

(g) fourth means for detecting the lead and trailing edges of flat objects being fed into peripheral contact with said cylindrical drum and for generating signals in response thereto; and (h) fifth means for controlling the movement of said cylindrical valve in response to the signals generated by said fourth means.

2. A stacker as recited in claim 1 wherein said second means comprise a cylindrical cavity in said fixed cylindrical body.

3. A stacker as recited in claim 2 wherein said cylindrical cavity is coaxial with said fixed cylindrical body.

4. A stacker as recited in claim 1 wherein said through holes in said cylindrical drum are spaced equiangularly around the periphery of said cylindrical drum.

5. A stacker as recited in claim 1 wherein said through holes in said cylindrical drum are spaced helically around the periphery of said cylindrical drum.

6. A stacker as recited in claim 1 and further comprising sixth means for moving a stack of stacked flat objects away from said cylindrical drum such that there is just room for one more flat object to be inserted between the stack and said cylindrical drum as each flat object approaches the nip between the stack and said cylindrical drum.

* * * * *